US008405470B2

(12) United States Patent
Itoh et al.

(10) Patent No.: US 8,405,470 B2
(45) Date of Patent: Mar. 26, 2013

(54) DIPLEXER SYNTHESIS USING COMPOSITE RIGHT/LEFT-HANDED PHASE-ADVANCE/DELAY LINES

(75) Inventors: Tatsuo Itoh, Rolling Hills, CA (US); Pei-Ling Chi, Los Angeles, CA (US)

(73) Assignee: The Regents of The University of California, Oakland, CA (US)

( * ) Notice: Subject to any disclaimer, the term of this patent is extended or adjusted under 35 U.S.C. 154(b) by 363 days.

(21) Appl. No.: 12/780,190

(22) Filed: May 14, 2010

(65) Prior Publication Data

US 2010/0295630 A1 Nov. 25, 2010

Related U.S. Application Data

(60) Provisional application No. 61/179,963, filed on May 20, 2009.

(51) Int. Cl.
*H01P 5/12* (2006.01)

(52) U.S. Cl. ..... 333/126; 333/109; 333/117; 333/120

(58) Field of Classification Search ..... 333/109, 333/117, 118, 120, 124–129, 132, 134
See application file for complete search history.

(56) References Cited

U.S. PATENT DOCUMENTS

| | | | |
|---|---|---|---|
| 7,482,893 | B2 | 1/2009 | Itoh et al. |
| 7,508,283 | B2 | 3/2009 | Itoh et al. |
| 7,667,555 | B2 | 2/2010 | Itoh et al. |
| 7,675,384 | B2 | 3/2010 | Itoh et al. |
| 2002/0140518 | A1 | 10/2002 | Verghese |
| 2009/0002093 | A1 | 1/2009 | Itoh et al. |

FOREIGN PATENT DOCUMENTS

| | | | |
|---|---|---|---|
| JP | 06-216687 | A | 8/1994 |
| KR | 1020080062587 | A | 7/2008 |
| KR | 1020090022024 | A | 3/2009 |

OTHER PUBLICATIONS

Macchiarella, G. et al.—"Novel Approach to the Synthesis of Microwave Diplexers"—IEEE Trans. on Microwave Theory and Techniques, Dec. 2006, vol. 54, No. 12, pp. 4281-4290.
Packiaraj, D. et al.—"Cavity Diplexer Using Tapped Line Interdigital Filters"—Proc. of 2005 Asia-Pacific Microwave, Conf. vol. 1, Dec. 4-7, 2005.
Sheta, A.F. et al.—"Miniature Microstrip Stepped Impedence Resonator Bandpass Filters and Diplexers for Mobile Communications"—Jun. 17-21, 1996 IEEE MTT-S International Microwave Symp. Digest, vol. 2, pp. 607-610.
Chen, C. et al.—"Microstrip Diplexers Design with Common Resonator Sections for Compact Size, But High Isolation"—IEEE Transactions on Microwave Theory and Techniques, vol. 54, No. 5, May 2006.

(Continued)

*Primary Examiner* — Robert Pascal
*Assistant Examiner* — Kimberly Glenn
(74) *Attorney, Agent, or Firm* — John P. O'Banion

(57) ABSTRACT

A diplexing apparatus and method which utilizes composite right/left-handed (CRLH) phase-advance/delay lines combined with a coupler. By engineering CRLH-based transmission lines with desired phase responses at two arbitrary frequencies of interest, the connected CRLH delay line and/or CRLH coupler are excited in a manner such that signals at designated frequencies are separated to the corresponding output ports of the hybrid coupler. Benefits of the apparatus include elimination of design complexities such as optimization of the interconnection junctions and the harmonic spurious suppression involved in conventional filter-based diplexers. In addition, channel isolation is beneficially achieved from the isolation property of directional couplers. Measured insertion loss on the implementations was found to be less than 1 dB, with isolation greater than 20 dB in the dual bands. A high level of agreement was observed between simulated and measured results.

20 Claims, 10 Drawing Sheets

OTHER PUBLICATIONS

Weng, M. et al.—"A Haripin Line Diplexer for Direct Sequence Ultra-Wideband Wireless Communications"—IEEE Microwave and Wireless Components Letters, vol. 17, No. 7, Jul. 2007, pp. 519-521.

Chen, X. et al.—"Desgin of Microstrip Diplexer with Wide Band-Stop"—2007 International Microwave and Millimeter Tech. Conf., Apr. 18-21, 2007.

Chi, P. et al.—"Metamaterial-Based Components for a Compact Dual-Band Beam Pattern Diversity System"—Proc. of the 38th Euro. Microwave Conference, Amsterdam, The Netherlands, Oct. 2008, pp. 555-558.

Chi, P. et al—"A Compact Dual-Band Metamaterial-Based Rat-Race Coupler for a MIMO System Application"—2008 IRRR MTT-S International Microwave Symp. Digest, Jun. 15-20, 2008, pp. 667-670.

International Search Report and Written Opinion from corresponding PCT International Patent Application No. PCT/US10/034903, report issued Dec. 8, 2010, pp. 1-9.

European Patent Office, Extended Supplementary Search Report issued Dec. 10, 2012, for Related European Patent Application No. 10778170.0 (pp. 1-5) and Claims Examined (pp. 6-8).

Castro-Galan et al., "Novel Diplexer Based on CRLH Transmission Lines," 2005 European Microwave Conference CNIT LA Defense, Paris, France Oct. 4-6, 2005, Piscataway, NJ, USA, IEEE, vol. 1, Oct. 4, 2005, pp. 133-136.

DIPLEXER SYNTHESIS USING COMPOSITE RIGHT/LEFT-HANDED PHASE-ADVANCE/DELAY LINES

CROSS-REFERENCE TO RELATED APPLICATIONS

This application claims priority from U.S. provisional application Ser. No. 61/179,963 filed on May 20, 2009, incorporated herein by reference in its entirety.

This application is related to U.S. Pat. No. 7,508,283, U.S. Pat. No. 7,675,384, U.S. Pat. No. 7,667,555, and U.S. patent application Ser. No. 12/122,311 filed on May 16, 2008, all of which are incorporated herein by reference in their entireties.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

A portion of the material in this patent document is also subject to protection under the maskwork registration laws of the United States and of other countries. The owner of the maskwork rights has no objection to the facsimile reproduction by anyone of the patent document or the patent disclosure, as it appears in the United States Patent and Trademark Office publicly available file or records, but otherwise reserves all maskwork rights whatsoever. The maskwork owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to a diplexer, and more particularly to diplexer utilizing composite right/left-handed (CRLH) phase advance/delay lines in combination with a hybrid coupler.

2. Description of Related Art

Modern communication systems often require dual-band operation, and therefore, diplexers are essential elements in transceiver modules for the electromagnetic spectrum. A diplexer is a form of frequency selective demultiplexer having one input and two outputs. One application of a diplexer allows two different devices at different frequencies to share a common communications channel. Diplexers have a wide range of applications for signal transmission in the electromagnetic spectrum. For decades, studies on diplexers attracted industry attention with the results of numerous researchers reported.

However, these diplexers have conventionally comprised two bandpass filters, each of which is responsible for the respective frequencies in dual-band schemes. More recently diplexers have been proposed which comprise waveguide filters. Although low insertion loss and high isolation were obtained from these waveguide filter diplexers, parametric optimization on the three-port junction connecting the filters and the requisite performance tuning are time-consuming processes. In order to suppress higher-order harmonics of filters, stepped-impedance resonators (SIRs) were utilized. In response to this arrangement, the spurious harmonic responses were controlled at the expense of design complexity. Even though channel isolation in diplexer design can perhaps be enhanced, it typically requires interconnection of additional circuit elements, such as tapped open stubs, and $\lambda/4$ microstrip lines in front of the filters.

Accordingly, a need exists for an apparatus and method for designing compact diplexers which simplify the design complexity by engineering the dispersion relation of the structure. These needs and others are met within the present invention, which overcomes the deficiencies of previously developed diplexing methods and apparatus.

BRIEF SUMMARY OF THE INVENTION

The present invention teaches a diplexer using composite right/left-handed (CRLH) phase-advance/delay lines combined with a coupler. Diplexers according to the invention can be implemented using CRLH-based transmission lines with desired phase responses at two arbitrary frequencies of interest through a connected CRLH hybrid coupler which is excited so that signals at designated frequencies are separated to the corresponding output ports of the coupler. It will be appreciated that composite right/left-handed (CRLH) transmission lines (TL) are constituted of series-L/shunt-C, series-C/shunt-L, and the series combination of the two, respectively. It should be noted that below a frequency $\omega_0$ the CRLH-TL is dominated by the LH contribution which provides anti-parallel phase/group velocities, while above frequency $\omega_0$ the dominant mode is RH with parallel and same sign phase/group velocities. The diplexer apparatus embodiments are configured for operation through a microwave frequency range, with transition frequency $\omega_0$ at or above approximately 100 MHz. The present invention teaches novel microwave diplexers utilizing these CRLH elements.

Based on the present configuration, design complexities such as optimization of the interconnection junctions and the harmonic spurious suppression involved in conventional filter-based diplexers can be avoided. In addition, channel isolation is beneficially achieved from the isolation property of directional couplers. The measured insertion loss is less than 1 dB while isolation between the dual bands is better than 20 dB. In testing implementations of the invention a high level of agreement was found between simulated and measured response characteristics.

CRLH transmission structures are described whose phase can be engineered by selecting the constituent circuit parameters. Therefore, suitable diplexers can be constructed with desirable characteristic impedances and phase responses at the frequencies of interest. The CRLH delay line utilizing the unique phase-controllable feature of the CRLH phase-advance/delay lines according to the invention contributes to generation of the signal phases needed for diplexing. Instead of employing two bandpass filters, the proposed diplexer is composed of a single-band power divider (e.g., Wilkinson power divider), CRLH phase-advance or delay lines, and a CRLH-based directional coupler. The power divider operates as a three-port matched junction, halving signals to the connected CRLH phase-advance or delay lines. This CRLH transmission structure is phase manipulated at dual frequencies to excite the subsequent directional coupler such that frequency selection takes place at the output ports of the coupler.

Embodiments of the present invention can be implemented in a number of alternative ways without departing from the teachings of the invention. By way of example and not limitation, two diplexer implementations are described herein. The first one demonstrates a diplexer with close passbands exemplified at 1.9 GHz and 2.4 GHz, using the (0°, −180°) CRLH delay line with a single-band CRLH 180° hybrid. The other diplexer exhibits the diplexing phenomenon which need not be within nearby passbands, and are exemplified at 1 GHz and 2 GHz using the (90°, 90°) CRLH phase-advance line with a dual-band 90° hybrid. It should be appreciated, however, that the present invention can be implemented across a range of frequencies, and that the elements of the invention can be combined in various ways with one another and what is known in the art, without departing from the teachings herein.

The aforementioned design complexities are reduced in diplexers based on this inventive topology, as validated by test results obtained for its example embodiments. Feasibility of these novel diplexers are thus verified by measured results showing input return loss and isolation are higher than 15 dB and 20 dB respectively. Moreover, the insertion loss is less than 1 dB in dual bands. Excellent agreement was obtained between simulated and measured results.

The invention is amenable to being embodied in a number of ways, including but not limited to the following descriptions.

One embodiment of the invention is configured as an apparatus (e.g., diplexer), comprising: (a) a power divider configured for splitting an input signal into a first signal and second signal; (b) a composite right/left-handed (CRLH) phase delay line having elements configured for delaying or advancing the phase of the first signal in relation to the second signal; and (c) a composite right/left-handed (CRLH) hybrid coupler connected to the first signal and the second signal and having a first output port and a second output port. During operation, a first operating frequency $f_1$ received within the input signal is output from the first output port, and a second operating frequency $f_2$ received within the input signal are output from the second output port.

In at least one implementation, the power divider is configured as a three-port junction outputting the first signal and the second signal which are in phase with each other with equal frequency makeup and at substantially equal power. In at least one implementation, the power divider comprises a Wilkinson power divider.

In at least one implementation, the phase delay line is configured for introducing a first phase delay (or advance), at a first operating frequency $f_1$, and a second phase delay or advance at a second operating frequency $f_2$.

In at least one implementation, the CRLH hybrid coupler comprises composite right/left-handed (CRLH) transmission line (TL) material having both right-handed (RH) and left-handed (LH) characteristics. The LH contributions of the coupler are derived from a plurality of lumped elements comprising inductances and capacitances. The CRLH phase delay and the CRLH hybrid coupler line comprise transmission lines and lumped elements comprising inductances and capacitances which are determined in response to the frequencies selected for the first operating frequency $f_1$ and the second operating frequency $f_2$. The CRLH hybrid coupler preferably comprises a plurality of ports, including a sum port and a difference port, disposed along the CRLH hybrid and separated by either phase delays $\phi_1$, or phase advances $\phi_2$, to form a hybrid coupler.

In at least one implementation, the CRLH hybrid coupler comprises a CRLH hybrid ring. In at least one implementation, the CRLH hybrid coupler comprises a quadrature hybrid. The dual frequency characteristics of each transmission line (TL) segment of the CRLH hybrid coupler arise in response to an anti-parallel relationship between phase and group velocities below a transition frequency $\omega_0$, within left-handed material (LH) within the CRLH hybrid coupler, and a parallel relationship between phase and group velocities above transition frequency $\omega_0$ within the right-handed material (RH) within the CRLH hybrid coupler. The diplexer apparatus is configured for operation through a microwave frequency range, with transition frequency $\omega_0$ at or above approximately 100 MHz. The diplexer apparatus is configured for arbitrary dual-band operation at frequencies $f_1$ and $f_2$, in which $f_2$ need not be equal to $N \times f_1$, or have any specific fixed relationship with $f_1$, in response to utilizing TL segments with designable non-linear phase responses.

One embodiment of the invention is configured as an apparatus for diplexing an input signal, comprising: (a) a power divider configured for splitting an input signal into a first signal and a second signal which are in phase with each other having equal frequency makeup and at substantially equal power; (b) a composite right/left-handed (CRLH) phase delay line having elements configured for delaying or advancing the phase of the first signal in relation to the second signal; and (c) a composite right/left-handed (CRLH) hybrid ring coupler, connected to the first signal and the second signal, configured for single band operation having composite right/left-handed handed (CRLH) transmission line (TL) material with both right-handed (RH) and left-handed (LH) characteristics with a first output port and a second output port. In operation, a first operating frequency $f_1$ received within the input signal is output from the first output port, and a second operating frequency $f_2$ received within the input signal is output from the second output port. The single band operation of the hybrid ring spans a sufficiently narrow frequency range to include both the first operating frequency $f_1$ and the second operating frequency $f_2$. The phrase "sufficiently narrow" in this context being considered with respect to the operating characteristics of the coupler, which although operating off of its center frequency still needs to provide the necessary level of signal output for the application.

In at least one implementation, the composite CRLH phase delay line is configured for providing different phase delays at the first operating frequency $f_1$ than at the second operating frequency $f_2$. The dual frequency characteristics of each transmission line (TL) segment of the CRLH hybrid coupler arise in response to an anti-parallel relationship between phase and group velocities below a transition frequency $\omega_0$, within left-handed material (LH) within the CRLH hybrid coupler, and a parallel relationship between phase and group velocities above transition frequency $\omega_0$ within the right-handed material (RH) within the CRLH hybrid coupler.

One embodiment of the invention is configured as an apparatus for diplexing an input signal, comprising: (a) a power divider configured for splitting an input signal into a first signal and a second signal which are in phase with each other having equal frequency makeup and at substantially equal power; (b) a composite right/left-handed (CRLH) phase delay line having elements configured for delaying or advancing the phase of the first signal in relation to the second signal; and (c) a composite right/left-handed (CRLH) quadrature hybrid coupler, connected to the first signal and the second signal, configured for dual band operation having composite right/left-handed (CRLH) transmission line (TL) material with both right-handed (RH) and left-handed (LH) characteristics with a first output port and a second output port. During operation, the first operating frequency $f_1$ received within the input signal is output from the first output port, and a second operating frequency $f_2$ received within the input signal is output from the second output port. The composite CRLH phase delay line is configured for providing the same phase delay or advance at the first operating frequency $f_1$ and at the second operating frequency $f_2$.

One embodiment of the invention is configured as a method comprising: (a) dividing a microwave input signal, containing a first frequency and a second frequency, into a first signal and second signal which both contain the first frequency and the second frequency; (b) delaying (e.g., positive or negative delay) the phase of either the first signal or the second signal in relation to one another; and (c) demultiplexing in the frequency domain the first frequency as output from a first port on a hybrid coupler device, and the second frequency as output from a second port on the hybrid coupler device.

The present invention provides a number of beneficial elements which can be implemented either separately or in any desired combination without departing from the present teachings.

An element of the invention is a diplexer using composite right/left hand (CRLH) phase-advance/delay lines interoperably coupled to a hybrid coupler.

Another element of the invention is a diplexer combining a power divider, to a CRLH delay line section (phase delay or advance), and a coupler.

Another element of the invention is a diplexer utilizing a single-band hybrid ring coupler for signals that have sufficiently close frequencies (e.g., nearby passbands) to assure proper hybrid ring operation off of its single band center frequency.

Another element of the invention is a diplexer utilizing a dual-band quadrature hybrid coupler.

Another element of the invention is a diplexer which can operate at any desired first and second frequencies.

Another element of the invention is a diplexer configured for operation through a microwave frequency range, with transition frequency $\omega_0$ at or above approximately 100 MHz.

Another element of the invention is a diplexer utilizing a CRLH hybrid coupler having two input ports and at least two output ports and whose TL segments exhibit either phase delays $\phi_1$, or phase advances $\phi_2$.

Another element of the invention is a diplexer incorporating a CRLH hybrid coupler comprising composite right/left-handed (CRLH) transmission line (TL) material having both right-handed (RH) and left-handed (LH) characteristics.

Another element of the invention is a diplexer incorporating a CRLH hybrid coupler having a plurality of lumped elements comprising inductances and capacitances for said LH operations of said CRLH TL.

A still further element of the invention is a compact diplexer that can be utilized in a wide variety of applications.

Further element of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1A through FIG. 8. It will be appreciated that the apparatus may vary as to configuration and as to details of the parts, and that the method may vary as to the specific steps and sequence, without departing from the basic concepts as disclosed herein. Furthermore, elements represented in one embodiment as taught herein are applicable without limitation to other embodiments taught herein, and combinations with those embodiments and what is known in the art.

1. Diplexer Embodiment Utilizing Single-Band Ring-Hybrid.

Figure 1A:
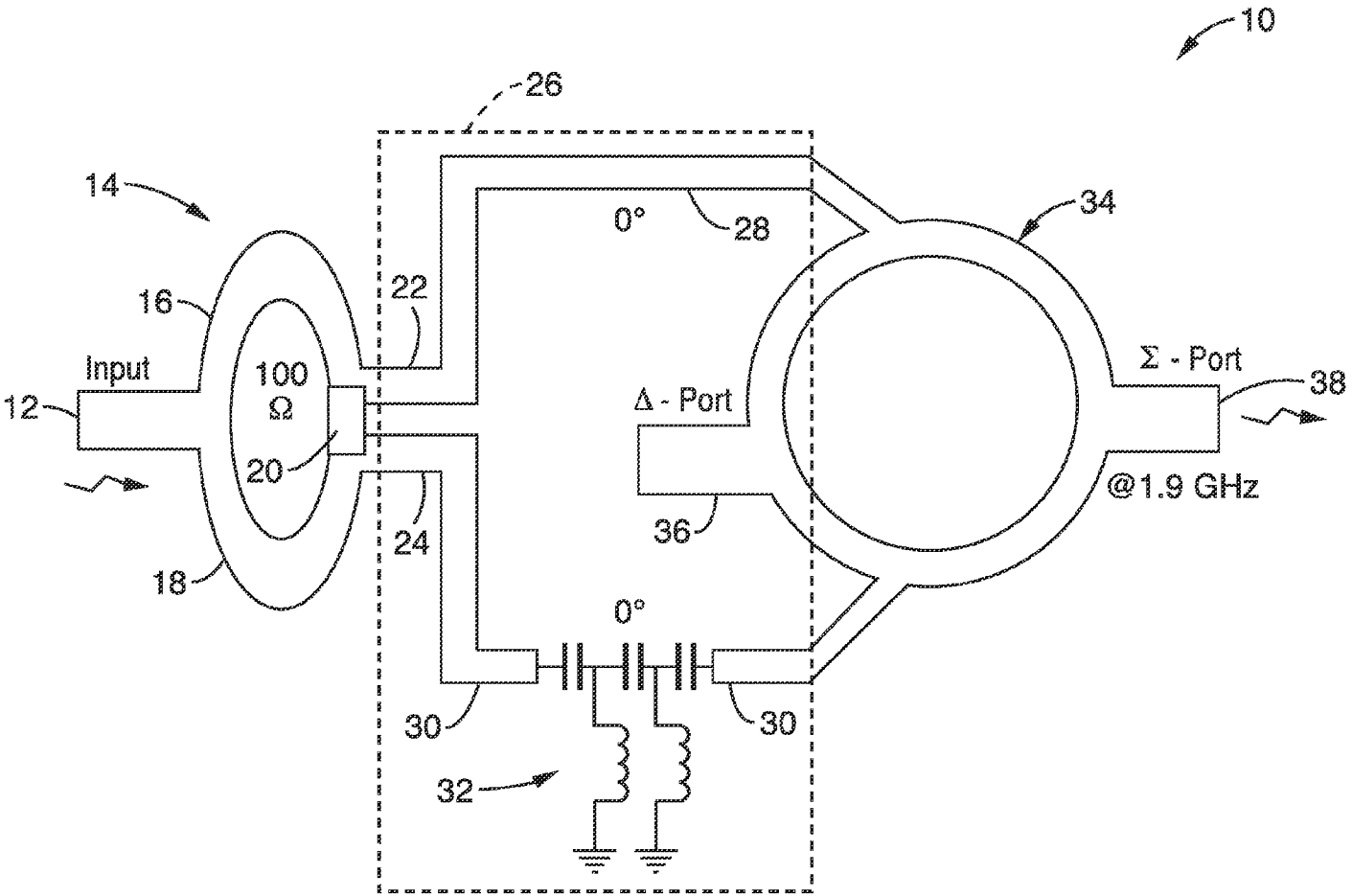
FIGS. 1A and 1B are schematic illustrations of a ring-hybrid diplexer according to at least one embodiment of the present invention, shown in its operating mode of 1.9 GHz in FIG. 1A and 2.4 GHz in FIG. 1B.
Figure 1B:
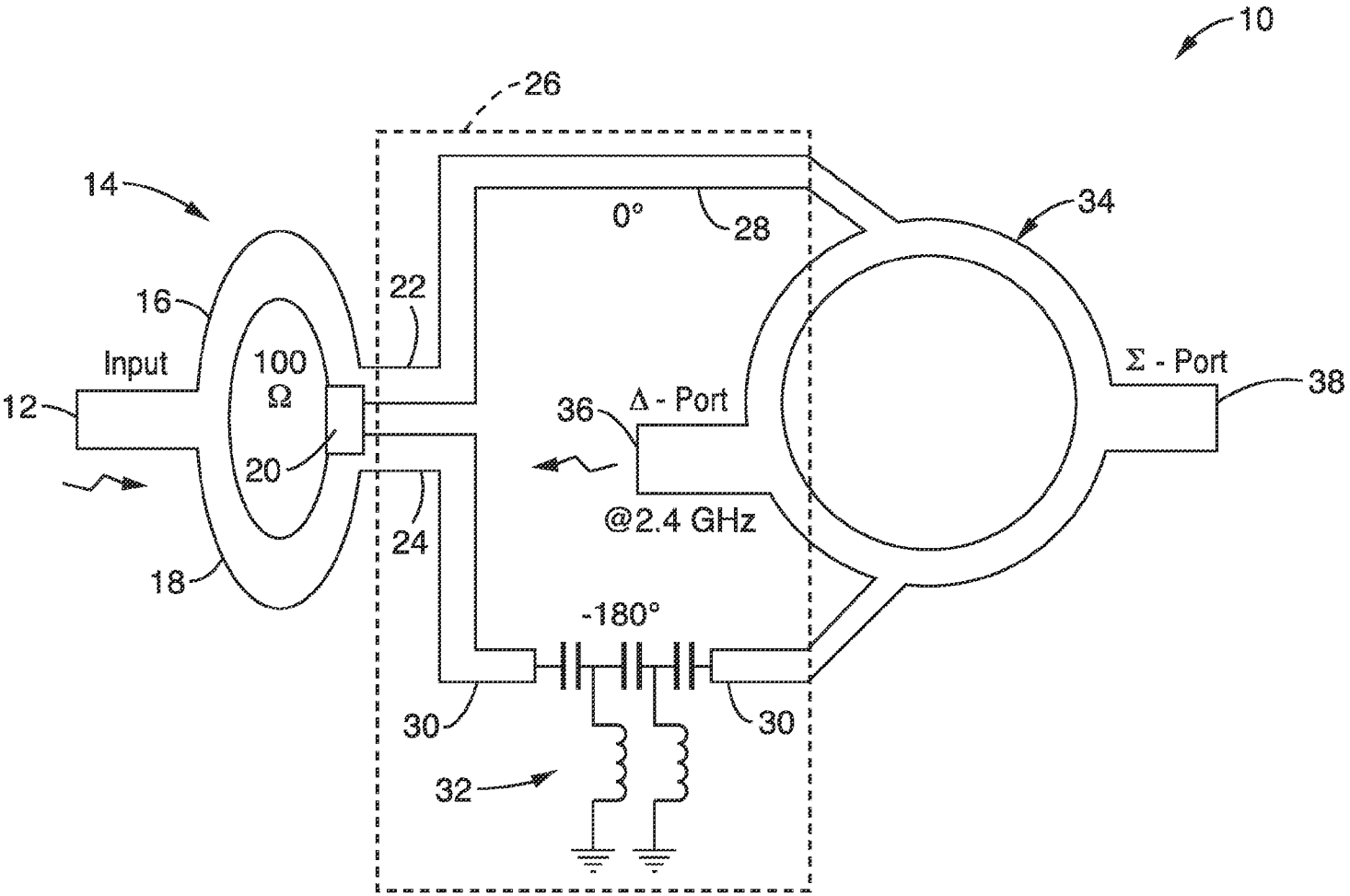

FIG. 1A and FIG. 1B illustrate an example embodiment 10 of a diplexer whose operation is based on a ring-hybrid, referred to herein as a ring-hybrid diplexer. The specific device comprising a power divider, phase delay line section, and hybrid coupler is shown in its operating modes for a first frequency (1.9 GHz) in FIG. 1A and a second operating frequency (2.4 GHz) in FIG. 1B.

The ring-hybrid diplexer 10 has an input 12 leading into a single-band Wilkinson power divider 14 having a first side 16, second side 18 and a terminator 20. It should be appreciated that the 100Ω terminator shown on the power divider is shown by way of example and not limitation, as other terminators can be utilized depending on the desired circuit characteristics. Two outputs 22, 24 are shown from the power divider 14, into a delay line section 26. The first output 22 leads to a first transmission line segment 28 within delay line section 26, while the second output 24 leads to a second transmission line segment 30. Interposed along one or more of the transmission line (TL) segments, such as depicted along the second transmission line segment 30, is a composite right/left hand (CRLH) phase delay section 32. First and second transmission line segments 28, 30 are coupled to a hybrid 34, shown comprising a single-band CRLH 180° hybrid having a first output port 36 (Δ port) and a second output port 38 (Σ port).

FIG. 1A illustrates that in response to an operating frequency of 1.9 GHz, the CRLH delay line contributes 0° of phase delay from delay line 32, with the diplexer output generated from the E (sigma-sum) port 38. FIG. 1B illustrates the same diplexer in response to an operating frequency of 2.4 Ghz, in which the delay line 32 contributes 180° of phase shift, and the output from the hybrid ring is generated from the A (delta-difference) output port 36.

The two-way Wilkinson power divider 14 acts as a three-port junction, which provides the subsequently connected CRLH phase-delay line pair with in-phase signals having an equal frequency makeup and a substantially even power split. Although other splitters can be utilized, the simple construction and three-port impedance matching of the Wilkinson divider make it particularly well-suited as the interconnection junction. The dual-band CRLH delay line provides for exciting the 180° coupler, preferably the hybrid-ring coupler shown, with in-phase and anti-phase inputs at two respective frequencies.

Delay line 32 is configured with CRLH transmission structures to provide arbitrary dual-band operation, and is designed to have (0°, −180°) phase responses at a first and second operating frequency. The example implementation of embodiment 10 depicts a diplexer designed for a first frequency of 1.9 GHz and a second frequency of 2.4 GHz, and a characteristic impedance of 50 Ω.

As shown in FIG. 1A, at 1.9 GHz the phase progression along two paths of the delay line are identical, which helps signal construction at the Σ port 38. On the other hand, the anti-phase signals from the delay line cause signals at 2.4 GHz to appear at the Δ port 36 as indicated in FIG. 1B. Therefore, the frequency selective mechanism is achieved.

The phase nonlinearity and controllability of the CRLH structures allow arbitrary dual-band operation while keeping the diplexer structure compact. At least one embodiment of the invention can be implemented using a single-band 180° hybrid for diplexing nearby passbands in response to a sufficiently narrow frequency split. A remarkable advantage of employing a CRLH single-band 180° hybrid is that footprint size can be reduced significantly.

The single-band hybrid-ring coupler is configured for generating separate signal channels from a radio-frequency input. A first and second input port and first and second output port are disposed along a transmission line (TL) ring. One or more of the TL segments about the ring incorporate one or more CRLH TL. Within one compact implementation of the hybrid ring coupler, three CRLH-TL sections contain lumped components, such as SMT chips or similar small surface mountable devices. Since these sections can provide a 90° phase advance, the remaining transmission line segment needs to provide only 90° phase delay instead of the +270° line section of a conventional ring to reduce size and enhance operating bandwidth compared to a conventional hybrid ring.

By way of example and not limitation, the single-band coupler operates at 2.15 GHz, which is the mid-band of two diplexer frequencies. The single-band hybrid comprises three identical CRLH transmission arms with phase-advance response of 90° and a microstrip line with a phase-lag response of −90° at 2.15 GHz. The 90° and −90° transmission structures replace the corresponding conventional λ/4 and 3λ/4 microstrip lines which leads to significant size reductions. Based on the topology using chip components and microstrip lines contributing to left- and right-handedness, respectively, a miniaturization of 86.2% is achieved compared to the single-band microstrip 180° coupler. In the example implementation, two unit-cell lumped elements are utilized having shunt inductance and series capacitance ($L_L$=5.1 nH, $C_L$=1 pF) in the CRLH transmission structures.

The CRLH delay line is characterized to provide phase responses of 0° and −180° at frequencies of 1.9 GHz and 2.4 GHz, respectively. These phase responses are implemented as phase differences between two paths into the ring-hybrid module. The delay line comprises a CRLH transmission structure in cooperation with a microstrip line. In order to maintain the impedance match, a characteristic impedance of 50Ω is considered for both lines, although it should be appreciated that the microstrip impedance can be configured at any desired practical value to suit a given application. It will be understood that the phase lag of the CRLH structure at 1.9 GHz and 2.4 GHz, is 0° and 180°, respectively, relative to the microstrip line. In order to fulfill such phase specification, the required right-handed microstrip lines in the CRLH transmission structure are relatively long. The necessity of the long lines is because the phase delay path in the synthesized CRLH structures is proportional to the rate of phase descending. Therefore, physically long microstrip lines are necessary for a large phase decrease (180°) at two close frequencies. Accordingly, this property is deterministic of overall diplexer dimensions. By way of example and not limitation, five unit-cell lumped elements are utilized in this implementation, with a shunt inductance and series capacitance ($L_L$=3.9 nH, $C_L$=1.2 pF) in the CRLH transmission structures.

Figure 2:
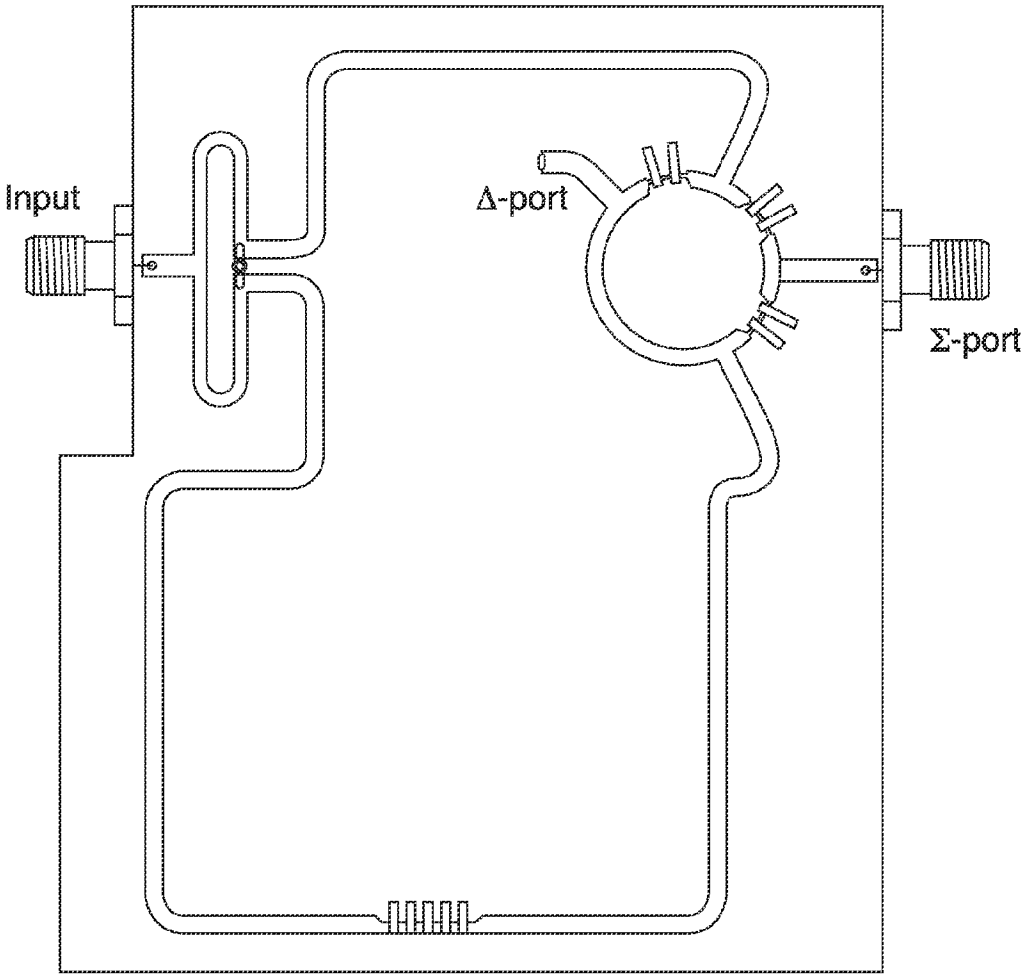
FIG. 2 is an image of a ring-hybrid diplexer configured for 1.9 GHz and 2.4 GHz operation, according to at least one embodiment of the present invention.

FIG. 2 depicts an actual implementation of the ring-hybrid diplexer configured for operation at 1.9 GHz and 2.4 GHz, which uses a single-band Wilkinson power divider, a CRLH delay line, and a single-band CRLH ring hybrid. This example diplexer implementation was built on a Duroid/RT 5870 substrate with thickness h=0.787 mm and relative dielectric constant $\in_r$=2.33.

Figure 3:
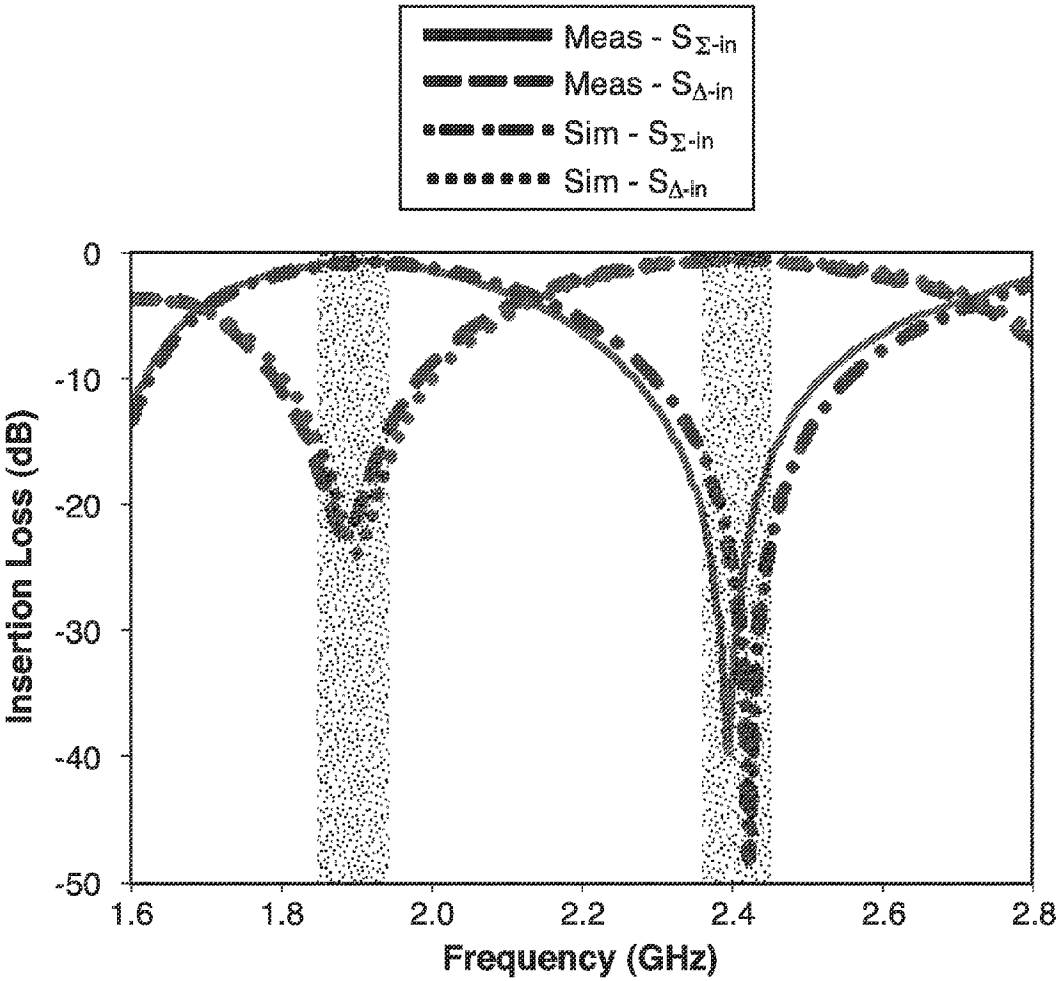
FIG. 3 is a graph of both simulated and measured insertion loss for the ring-hybrid diplexer, according to at least one embodiment of the present invention.

FIG. 3 depicts simulated and measured insertion loss for the diplexer based on use of a ring-hybrid coupler (hereinafter referred to for simplicity as a ring-hybrid diplexer) as shown in FIG. 1A, FIG. 1B, and FIG. 2. The measured insertion loss is −0.7 dB and −0.6 dB at 1.9 GHz and 2.4 GHz respectively as shown in the graph. It will be noted that channel rejection effectively filters out other unwanted frequencies, while excellent agreement was achieved between the simulation and actual measurements on the device as implemented.

Figure 4:
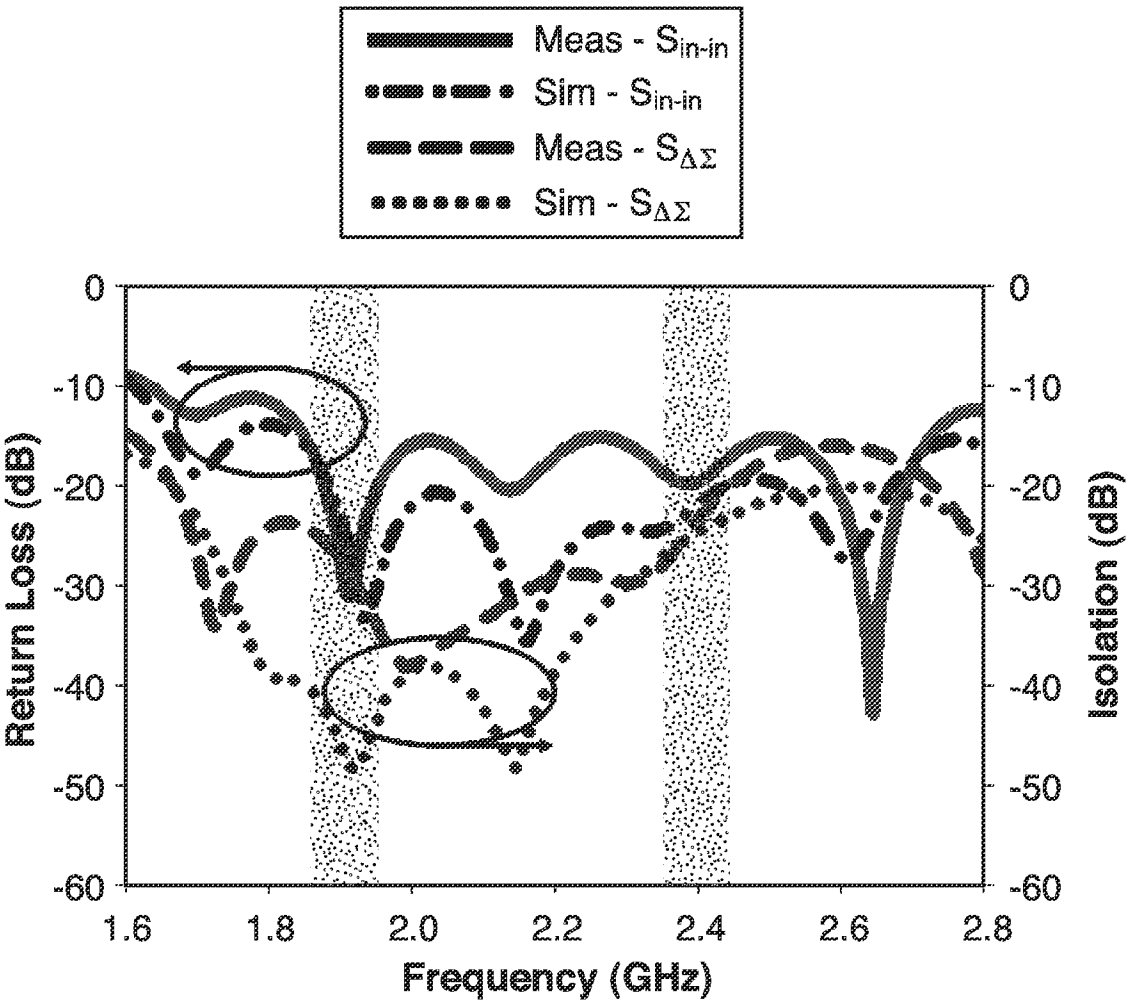
FIG. 4 is a graph of both simulated and measured input return loss and output isolation for the ring-hybrid diplexer, according to at least one embodiment of the present invention.

FIG. 4 depicts simulated and measured input return loss and output isolation for the ring-hybrid diplexer as shown in FIG. 1A, FIG. 1B, and FIG. 2. Return loss was measured at −27 dB and −20 dB for the frequencies of interest, at 1.9 GHz and 2.4 GHz respectively. Furthermore, −27 dB and −23 dB are the measured values of isolation provided at 1.9 GHz and 2.4 GHz respectively. The test results illustrate the beneficial nature of the present invention, wherein diplexer embodiments can be implemented without regard of interconnection junction optimization, spurious response suppression, and the need of additional components to provide improved isolation. Furthermore, although the measured three-port return losses are not included here due to lack of space, they are matched at all ports as expected. It should be appreciated that the overall device can be further miniaturized in response to using substrates which exhibit high dielectric constants, and/or in response to creating denser circuit layouts.

2. Diplexer Embodiment Utilizing Dual-Band Quadrature-Hybrid.

Figure 5A:
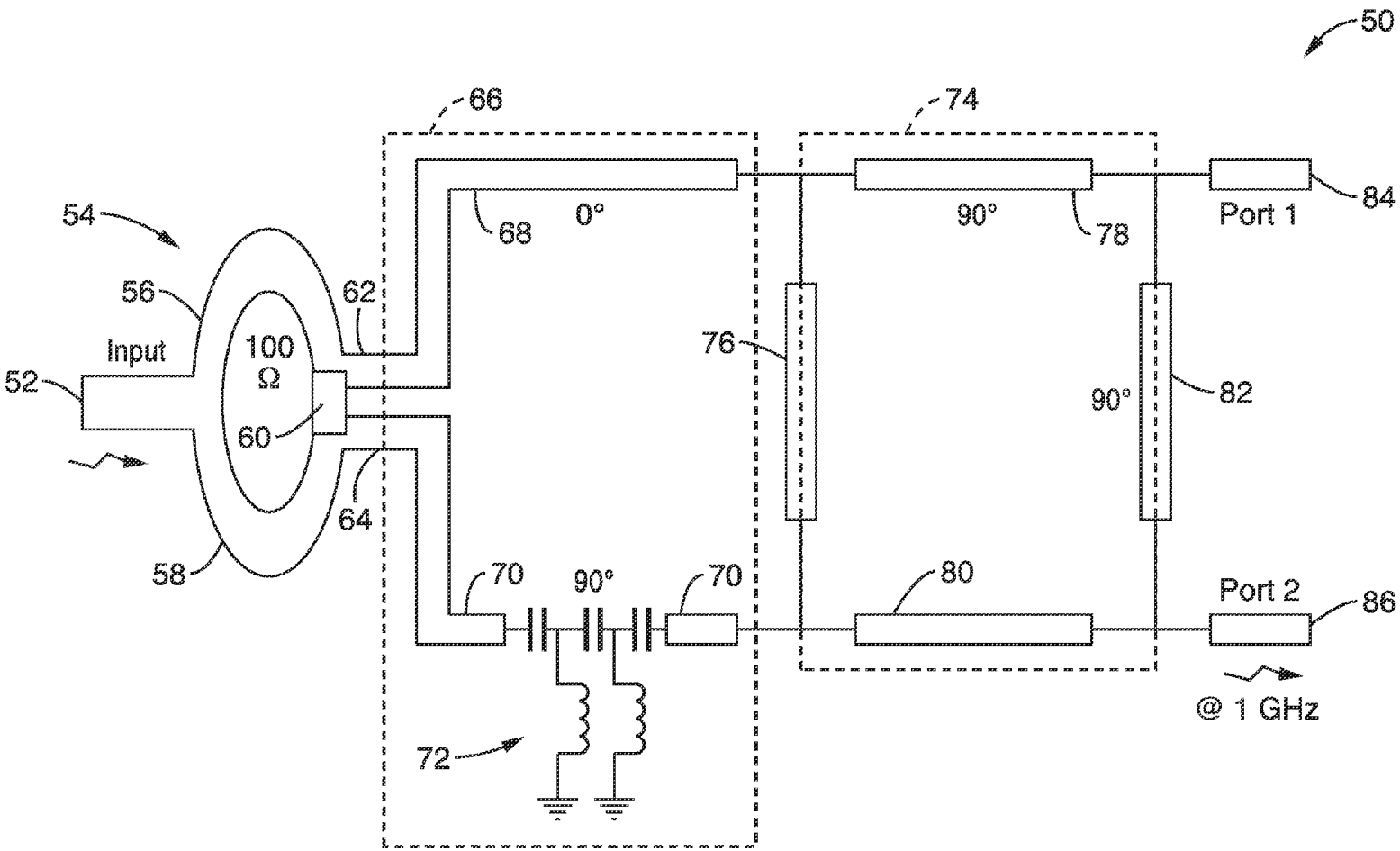
FIGS. 5A and 5B are schematic illustrations of a quadrature-hybrid diplexer according to at least one embodiment of the present invention, shown in its operating mode of 1 GHz in FIG. 5A and 2 GHz in FIG. 5B.
Figure 5B:
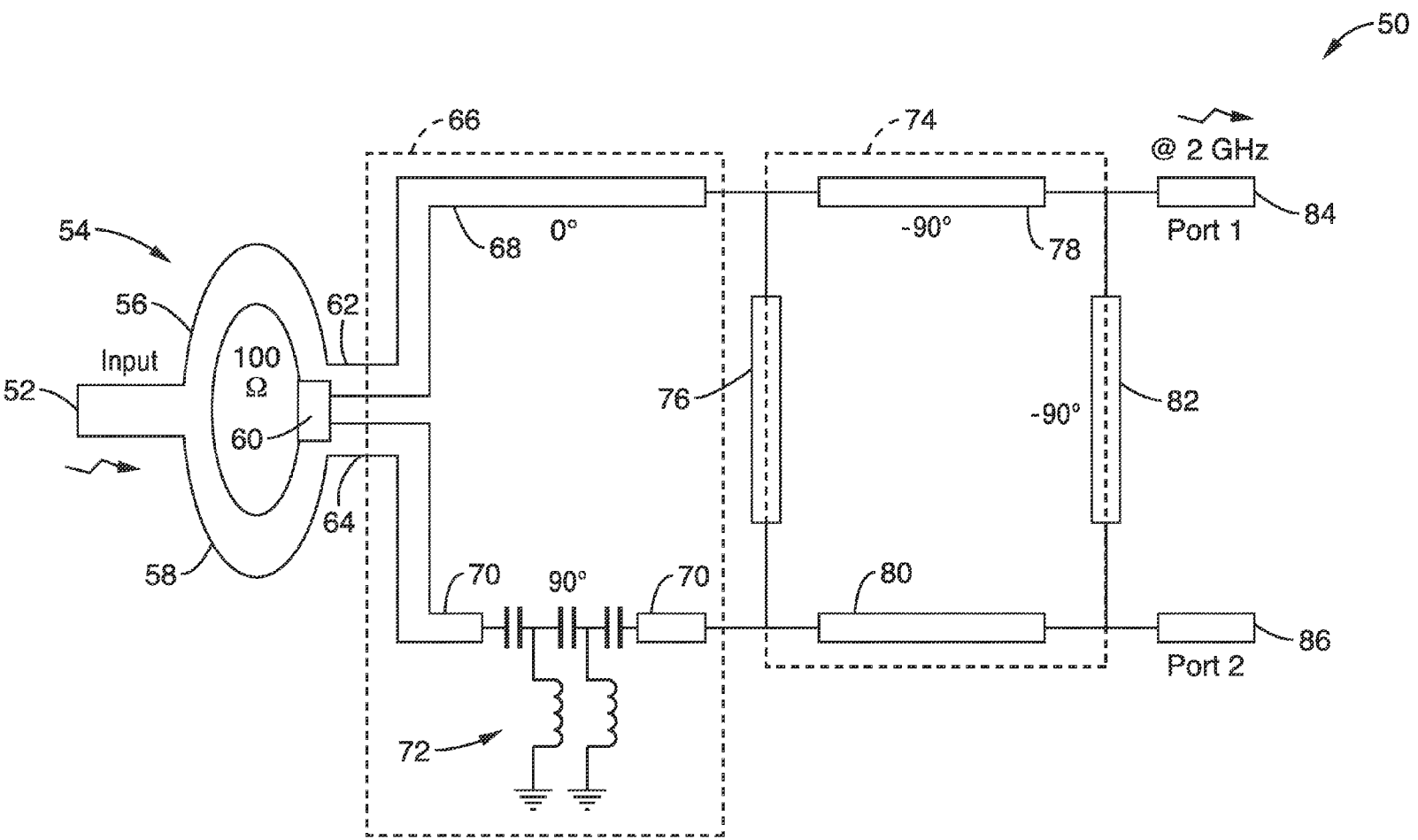

FIG. 5A and FIG. 5B illustrate an example embodiment 50 of a quadrature-hybrid diplexer comprising a power divider, phase advance section, and dual-band quadrature hybrid. In this example embodiment, the two frequencies ($f_1$, $f_2$) are considered too widely separated for efficient use of the single-band hybrid approach described in the prior section. In this implementation of the embodiment, the first frequency $f_1$ and the second frequency $f_2$ being diplexed are at 1 GHz as shown in FIG. 5A, and 2 GHz as represented in FIG. 5B.

In this second example embodiment, a quadrature-hybrid-based diplexer 50 is shown comprising an input 52, leading into a single-band power divider, exemplified as a Wilkinson power divider 54, having a first side 56, second side 58, and terminator 60 (e.g., a 100Ω terminator is shown). Two outputs 62, 64 are shown from the power divider 54 to a phase advance section 66. The first output 62 leads to a first transmission line segment 68, and the second output 64 leads to a second transmission line segment 70. A CRLH phase-advance line 72 is interposed along the length of second transmission line segment 70. It should be appreciated that a phase advance as described can be equivalently referred to as a negative value of phase delay. First and second transmission line segments are input to a dual-band CRLH 90° hybrid 74 having transmission line segments 76, 78, 80, and 82, depicted as comprising λ/4 CRLH sections. A first port 84 and second port 86 are shown extending from quadrature hybrid 74.

The two-way Wilkinson power divider 54 eases the junction design complexity and bisects signals evenly into the subsequent CRLH phase-advance section 66. The CRLH phase-advance section 66 is designed to exhibit a 90° phase-advance to excite the dual-band 90° coupler at both of the operating frequencies, which are 1 GHz, 2 GHz in the exemplified implementation to suite the phase responses of the dual-band CRLH 90° coupler. As shown in 5A at 1 GHz, the phase progression along each branch of the 90° coupler is 90° phase-advanced, whereby the constructive signal shows up at second port 86. However, signals at 2 GHz will be generated from the first port 84 when the −90° phase delay is assigned to each branch (76, 78, 80 and 82) of coupler 74 as shown FIG. 5B. The set of (90°, −90°) phase responses of the coupler are employed toward enhancing compactness. Therefore, the combination of (90°, 90°) CRLH phase-advance line with the (90°, −90°) quadrature hybrid is able to act as a diplexer at frequencies of interest.

The CRLH quadrature hybrid is configured for operation at two selected frequencies which can have any desired relationship to one another. The implementation of the LH segments of the CRLH-TLs is also preferably in an SMT chip component form, or similar discrete lumped device format. Although, any desired relation can exist between the two frequencies utilized, there are considerations with regard to compactness. Considerations include electrical performance of the chip components at higher frequencies and the required length of microstrip lines, for a given implementation topology, which increases as the frequency separation is decreased given fixed phase responses.

Toward optimizing miniaturization, transmission lines with phase advance are considered in this coupler and a dual-band CRLH 90° hybrid is used with phase responses of 90° and −90°. The dual-band CRLH hybrid is preferably composed of two pairs of CRLH transmission structures, such as having characteristic impedances 50Ω (76, 82) and $$\frac{50}{\sqrt{2}}\Omega$$

(78, 80) respectively. For each branch, the phase responses are 90° phase-advanced at 1 GHz and −90° phase-delayed at 2 GHz. In place of the traditional λ/4 microstrip lines, this quadrature hybrid is compact and capable of arbitrary dual-band operation. By the use of the CRLH structures as in the 180° hybrid (FIG. 1A, FIG. 1B, and FIG. 2), a size reduction of 11.6% was attained in comparison to a conventional 1 GHz 90° coupler.

In the example implementation of FIG. 5A and FIG. 5B, three unit-cell lumped elements, comprising the phase advance section 72 are disposed along the transmission line having shunt inductances and series capacitances for the two kinds of transmission structures in this example are ($L_{L,50}$=9.4 nH, $C_{L,50}$=2.8 pF, $L_{L,50/\sqrt{2}}$=6.2 nH, $C_{L,50/\sqrt{2}}$=4.2 pF). The CRLH phase-advance line is designed to have phase responses (90°, 90°) at (1 GHz, 2 GHz) in this example. This requirement is realized by pairing a CRLH transmission structure with a microstrip line so that the CRLH transmission structure is phase advanced by 90° at both frequencies. The characteristic impedance of 50Ω is used for both lines. Two unit-cell lumped elements are used. The shunt inductance and series capacitance are ($L_L$=15 nH, $C_L$=6 pF) in the CRLH transmission structures.

Figure 6:
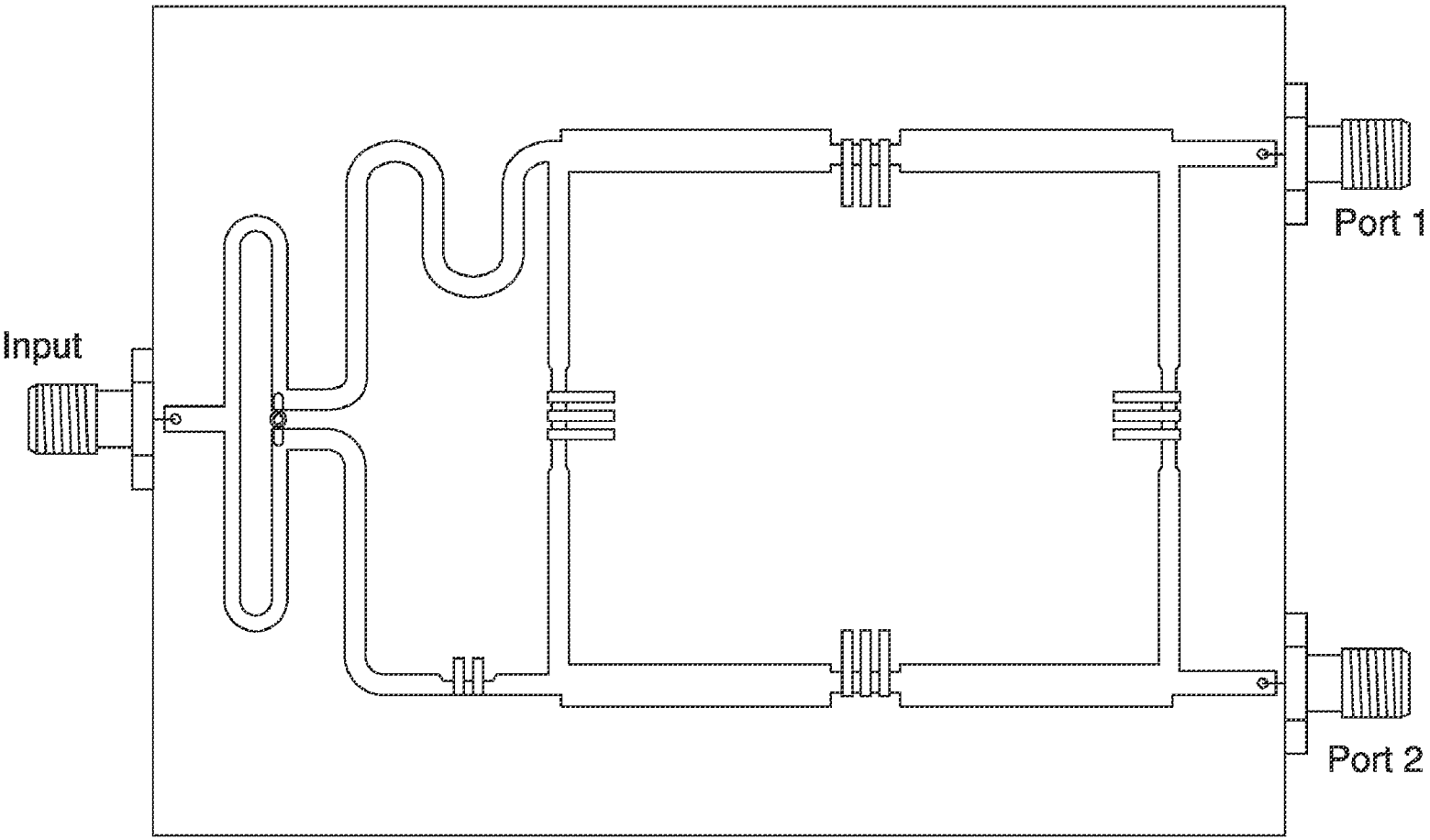
FIG. 6 is an image of a quadrature-hybrid diplexer configured for operation at 1 GHz and 2 GHz, according to at least one embodiment of the present invention.

FIG. 6 depicts an actual implementation of the quadrature-hybrid-based diplexer configured for operation at 1 GHz and 2 GHz, which uses a single-band Wilkinson power divider, a CRLH phase-advance line, and a dual-band CRLH quadrature hybrid. This diplexer was built on a Duroid/RT 5870 substrate with thickness h=0.787 mm and relative dielectric constant $\in_r$=2.33.

Figure 7:
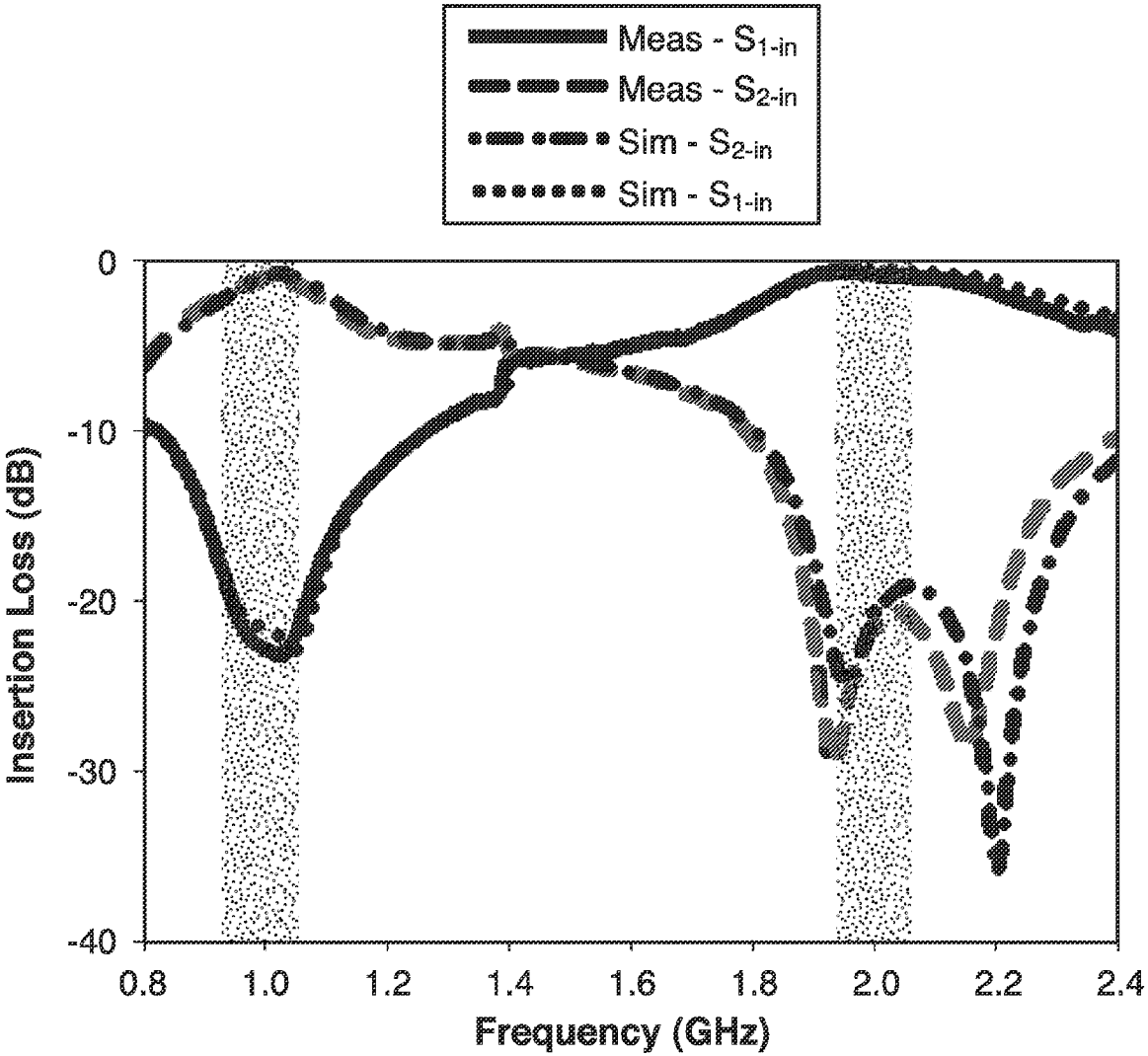
FIG. 7 is a graph of both simulated and measured insertion loss of the quadrature-hybrid diplexer, according to at least one embodiment of the present invention.

FIG. 7 depicts simulated and measured insertion loss for the quadrature-hybrid diplexer shown in FIG. 5A, FIG. 5B, and FIG. 6. The measured insertion loss is −1 dB and −0.9 dB at 1 GHz and 2 GHz respectively as shown in the graph. It will be noted that channel rejection, which filters out unwanted frequencies, is higher than 22 dB, while excellent agreement was achieved between the simulation and actual device measurements.

Figure 8:
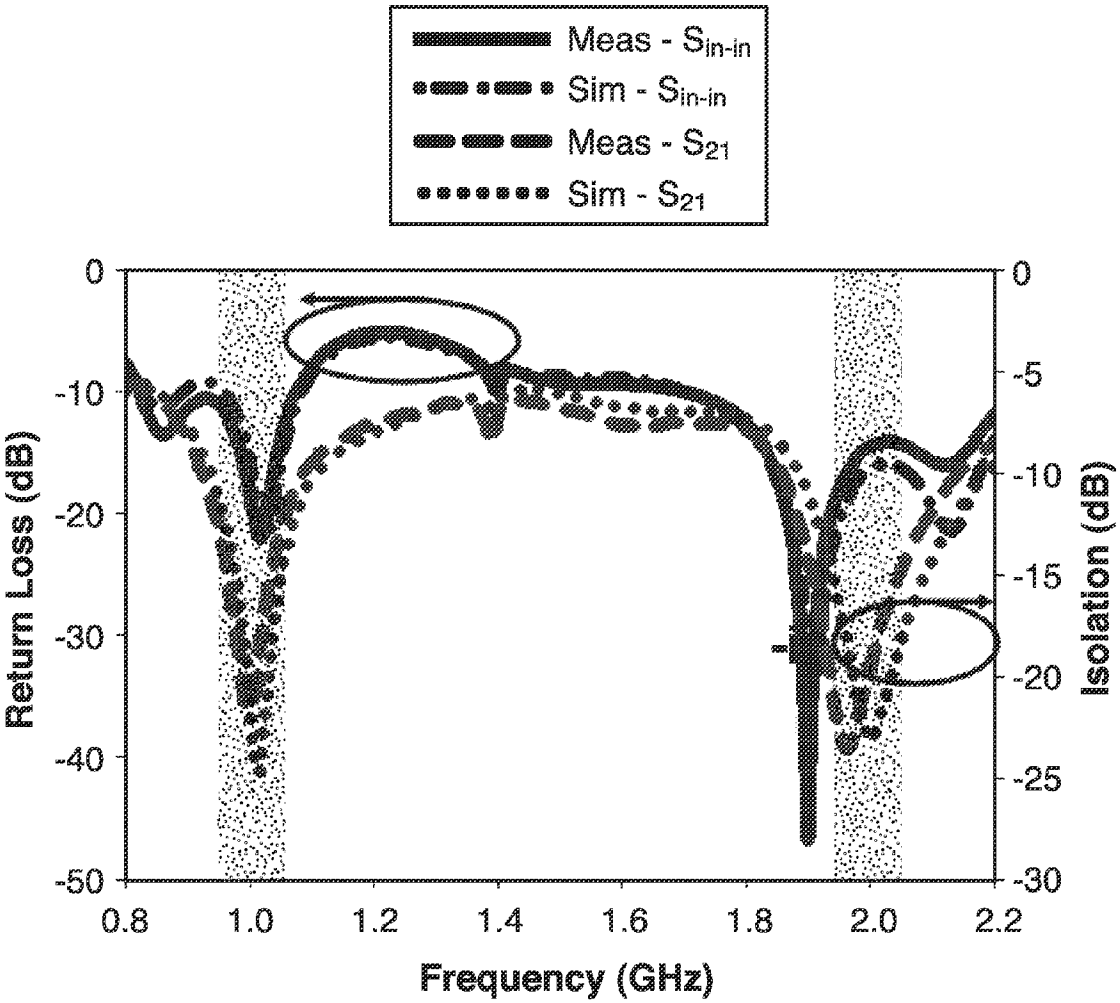
FIG. 8 is a graph of both simulated and measured input return loss and output isolation of the proposed quadrature-hybrid diplexer, according to at least one embodiment of the present invention.

FIG. 8. depicts simulated and measured input return loss and output isolation of the quadrature-hybrid-based diplexer shown in FIG. 5A, FIG. 5B, and FIG. 6. Return loss was measured at −19 dB and −15 dB, for the frequencies of interest at 1 GHz and 2 GHz respectively. Furthermore, isolations values of −22 dB and −20 dB were obtained at 1 GHz and 2 GHz respectively. The test results illustrate the beneficial nature of the present invention, wherein diplexer embodiments can be readily implemented while providing return loss matching at each port. It should be appreciated that the input return loss of this diplexer can be improved by employing a dual-band Wilkinson power divider operating at 1 GHz and 2 GHz at the expense of design complexity. It should also be appreciated that the overall size of the device can be further miniaturized if substrates exhibiting high dielectric constants are utilized, and/or in response to the use of more dense circuit layouts.

Accordingly, a novel and simple method for diplexer construction using composite right/left-handed phase-advance/delay lines, and attendant example apparatus, have been presented. Using the above-described configuration, the diplexers are easily constructed without considering three-port junction optimization, filtering of spurious responses at harmonic frequencies, and improved isolation. Measurements obtained from implementation of the devices verify the feasibility and beneficial nature of the invention.

The present invention provides diplexing methods and apparatus utilizing a power divider, CRLH delay section, and CRLH hybrid coupler, which can be configured for two frequencies which need have no harmonic relationship with one another. Inventive teachings can be applied in a variety of apparatus and applications, including microwave signal demultiplexing, and so forth.

It will be appreciated, therefore, that the present invention can be embodied in various ways, which include the following:

1. An apparatus, comprising: a power divider configured for splitting an input signal into a first signal and second signal; a composite right/left-handed (CRLH) phase delay line having elements configured for delaying or advancing the phase of said first signal in relation to said second signal; and a composite right/left-handed (CRLH) hybrid coupler configured for receiving said first signal and said second signal and having a first output port and a second output port; wherein a first operating frequency $f_1$ received within said input signal is output from said first output port, and a second operating frequency $f_2$ received within said input signal is output from said second output port.

2. An apparatus according to embodiment 1, wherein said apparatus comprises a diplexer.

3. An apparatus according to embodiment 1, wherein said power divider is configured as a three-port junction outputting said first signal and said second signal which are in phase with each other with equal frequency makeup and at substantially equal power.

4. An apparatus according to embodiment 1, wherein said power divider comprises a Wilkinson power divider.

5. An apparatus according to embodiment 1, wherein said phase delay line is configured for introducing a first phase delay or advance at the first operating frequency $f_1$, and a second phase delay or advance at the second operating frequency $f_2$.

6. An apparatus according to embodiment 1, wherein said CRLH hybrid coupler comprises composite right/left-handed (CRLH) transmission line (TL) material having both right-handed (RH) and left-handed (LH) portions.

7. An apparatus according to embodiment 1, wherein said CRLH hybrid coupler comprises a plurality of lumped elements comprising inductances and capacitances within said LH portions of said CRLH TL.

8. An apparatus according to embodiment 1, wherein said CRLH phase delay line and said CRLH hybrid coupler comprise transmission lines and lumped elements comprising inductances and capacitances which are determined in response to frequencies selected for the first operating frequency $f_1$ and the second operating frequency $f_2$.

9. An apparatus according to embodiment 1, wherein said CRLH hybrid coupler comprises paths for said first signal and said second signal which are subject to different phase delays.

10. An apparatus according to embodiment 1, wherein said CRLH hybrid coupler comprises a plurality of ports, including a sum port and a difference port, disposed along said CRLH hybrid coupler and separated by either phase delays $\phi_1$, or phase advances $\phi_2$, to form a hybrid coupler.

11. An apparatus according to embodiment 1, wherein said CRLH hybrid coupler comprises a CRLH hybrid ring.

12. An apparatus according to embodiment 1, wherein said CRLH hybrid coupler comprises a CRLH quadrature hybrid.

13. An apparatus according to embodiment 1, wherein dual frequency characteristics of each transmission line (TL) segment of said CRLH hybrid coupler arise in response to an anti-parallel relationship between phase and group velocities below a transition frequency $\omega_0$, within left-handed (LH) portions within the CRLH hybrid coupler, and a parallel relationship between phase and group velocities above transition frequency $\omega_0$ within right-handed (RH) portions of the CRLH hybrid coupler.

14. An apparatus according to embodiment 1, wherein the apparatus is configured for operation through a microwave frequency range, with transition frequency $\omega_0$ at or above approximately 100 MHz.

15. An apparatus according to embodiment 1: wherein said apparatus is configured for arbitrary dual-band operation at frequencies $f_1$ and $f_2$; and wherein $f_2$ is independent of $f_1$, in response to utilizing TL segments with designable non-linear phase responses.

16. An apparatus for diplexing an input signal, comprising: a power divider configured for splitting an input signal into a first signal and a second signal which are in-phase with each other having equal frequency makeup and at substantially equal power; a composite right/left-handed (CRLH) phase delay line having elements configured for delaying or advancing the phase of said first signal in relation to said second signal; and a composite right/left-handed (CRLH) hybrid ring coupler, configured for receiving said first signal and said second signal, configured for single band operation having composite right/left-handed (CRLH) transmission line (TL) material with both right-handed (RH) and left-handed (LH) characteristics with a first output port and a second output port; wherein a first operating frequency $f_1$ received within said input signal is output from said first output port, and a second operating frequency $f_2$ received within said input signal is output from said second output port; wherein said single-band operation of said hybrid ring coupler spans a frequency range including both the first operating frequency $f_1$ and the second operating frequency $f_2$.

17. An apparatus according to embodiment 16, wherein said CRLH phase delay line is configured for providing a first phase delay at the first operating frequency $f_1$, and a second phase delay at the second operating frequency $f_2$, and in which the first phase delay and the second phase delay are not equal.

18. An apparatus according to embodiment 16, wherein dual frequency characteristics of each transmission line (TL) segment of said CRLH hybrid coupler arise in response to an anti-parallel relationship between phase and group velocities below a transition frequency $\omega_0$, within left-handed (LH) material within the CRLH hybrid coupler, and a parallel relationship between phase and group velocities above transition frequency $\omega_0$ within the right-handed material (RH) within the CRLH hybrid coupler.

19. An apparatus for diplexing an input signal, comprising: a power divider configured for splitting an input signal into a first signal and a second signal which are in phase with each other having equal frequency makeup and at substantially equal power; a composite right/left-handed (CRLH) phase delay line having elements configured for delaying or advancing the phase of said first signal in relation to said second signal; and a composite right/left-handed (CRLH) quadrature hybrid coupler, connected to said first signal and said second signal, configured for single band operation having composite right/left-handed (CRLH) transmission line (TL) material with both right-handed (RH) and left-handed (LH) characteristics with a first output port and a second output port; wherein said apparatus is configured for arbitrary dual-band operation at a first operating frequency $f_1$ and second operating frequency $f_2$, and in which $f_2$ need not be equal to $N \times f_1$, or is independent of $f_1$, in response to utilizing TL segments with designable non-linear phase responses; wherein the first operating frequency $f_1$ received within said input signal is output from said first output port, and the second operating frequency $f_2$ received within said input signal is output from said second output port.

20. An apparatus according to embodiment 19, wherein said CRLH phase delay line is configured for providing the same phase delay or advance at the first operating frequency $f_1$ and at the second operating frequency $f_2$.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus, comprising:

a power divider configured for splitting an input signal into a first signal and second signal;

a composite right/left-handed (CRLH) phase delay line having elements configured for delaying or advancing the phase of said first signal in relation to said second signal; and a composite right/left-handed (CRLH) hybrid coupler configured for receiving said first signal and said second signal and having a first output port and a second output port;

wherein a first operating frequency $f_1$ received within said input signal is output from said first output port, and a second operating frequency $f_2$ received within said input signal is output from said second output port.

2. An apparatus as recited in claim 1, wherein said apparatus comprises a diplexer.

3. An apparatus as recited in claim 1, wherein said power divider is configured as a three-port junction outputting said first signal and said second signal which are in phase with each other with equal frequency makeup and at substantially equal power.

4. An apparatus as recited in claim 1, wherein said power divider comprises a Wilkinson power divider.

5. An apparatus as recited in claim 1, wherein said phase delay line is configured for introducing a first phase delay or advance at the first operating frequency $f_1$, and a second phase delay or advance at the second operating frequency $f_2$.

6. An apparatus as recited in claim 1, wherein said CRLH hybrid coupler comprises composite right/left-handed (CRLH) transmission line (TL) material having both right-handed (RH) and left-handed (LH) portions.

7. An apparatus as recited in claim 1, wherein said CRLH hybrid coupler comprises a plurality of lumped elements comprising inductances and capacitances within said LH portions of said CRLH TL.

8. An apparatus as recited in claim 1, wherein said CRLH phase delay line and said CRLH hybrid coupler comprise transmission lines and lumped elements comprising inductances and capacitances which are determined in response to frequencies selected for the first operating frequency $f_1$ and the second operating frequency $f_2$.

9. An apparatus as recited in claim 1, wherein said CRLH hybrid coupler comprises paths for said first signal and said second signal which are subject to different phase delays.

10. An apparatus as recited in claim 1, wherein said CRLH hybrid coupler comprises a plurality of ports, including a sum port and a difference port, disposed along said CRLH hybrid coupler and separated by either phase delays $\phi_1$, or phase advances $\phi_2$, to form a hybrid coupler.

11. An apparatus as recited in claim 1, wherein said CRLH hybrid coupler comprises a CRLH hybrid ring.

12. An apparatus as recited in claim 1, wherein said CRLH hybrid coupler comprises a CRLH quadrature hybrid.

13. An apparatus as recited in claim 1, wherein dual frequency characteristics of each transmission line (TL) segment of said CRLH hybrid coupler arise in response to an anti-parallel relationship between phase and group velocities below a transition frequency $\omega_0$, within left-handed (LH) portions within the CRLH hybrid coupler, and a parallel relationship between phase and group velocities above transition frequency $\omega_0$ within right-handed (RH) portions of the CRLH hybrid coupler.

14. An apparatus as recited in claim 1, wherein the apparatus is configured for operation through a microwave frequency range, with transition frequency $\omega_0$ at or above approximately 100 MHz.

15. An apparatus as recited in claim 1:

wherein said apparatus is configured for arbitrary dual-band operation at frequencies $f_1$ and $f_2$; and wherein $f_2$ is independent of $f_1$, in response to utilizing TL segments with designable non-linear phase responses.

16. An apparatus for diplexing an input signal, comprising:

a power divider configured for splitting an input signal into a first signal and a second signal which are in-phase with each other having equal frequency makeup and at substantially equal power;

a composite right/left-handed (CRLH) phase delay line having elements configured for delaying or advancing the phase of said first signal in relation to said second signal; and a composite right/left-handed (CRLH) hybrid ring coupler, configured for receiving said first signal and said second signal, configured for single band operation having composite right/left-handed (CRLH) transmission line (TL) material with both right-handed (RH) and left-handed (LH) characteristics with a first output port and a second output port;

wherein a first operating frequency $f_1$ received within said input signal is output from said first output port, and a second operating frequency $f_2$ received within said input signal is output from said second output port;

wherein said single-band operation of said hybrid ring coupler spans a frequency range including both the first operating frequency $f_1$ and the second operating frequency $f_2$.

17. An apparatus as recited in claim 16, wherein said CRLH phase delay line is configured for providing a first phase delay at the first operating frequency $f_1$, and a second phase delay at the second operating frequency $f_2$, and in which the first phase delay and the second phase delay are not equal.

18. An apparatus as recited in claim 16, wherein dual frequency characteristics of each transmission line (TL) segment of said CRLH hybrid coupler arise in response to an anti-parallel relationship between phase and group velocities below a transition frequency $\omega_0$, within left-handed (LH) material within the CRLH hybrid coupler, and a parallel relationship between phase and group velocities above transition frequency $\omega_0$ within the right-handed material (RH) within the CRLH hybrid coupler.

19. An apparatus for diplexing an input signal, comprising:

a power divider configured for splitting an input signal into a first signal and a second signal which are in phase with each other having equal frequency makeup and at substantially equal power;

a composite right/left-handed (CRLH) phase delay line having elements configured for delaying or advancing the phase of said first signal in relation to said second signal; and a composite right/left-handed (CRLH) quadrature hybrid coupler, connected to said first signal and said second signal, configured for single band operation having composite right/left-handed (CRLH) transmission line (TL) material with both right-handed (RH) and left-handed (LH) characteristics with a first output port and a second output port;

wherein said apparatus is configured for arbitrary dual-band operation at a first operating frequency $f_1$ and second operating frequency $f_2$, and in which $f_2$ need not be equal to $N \times f_1$, or is independent of $f_1$, in response to utilizing TL segments with designable non-linear phase responses;

wherein the first operating frequency $f_1$ received within said input signal is output from said first output port, and the second operating frequency $f_2$ received within said input signal is output from said second output port.

20. An apparatus as recited in claim 19, wherein said CRLH phase delay line is configured for providing the same phase delay or advance at the first operating frequency $f_1$ and at the second operating frequency $f_2$.

* * * * *

UNITED STATES PATENT AND TRADEMARK OFFICE

CERTIFICATE OF CORRECTION

PATENT NO. : 8,405,470 B2
APPLICATION NO. : 12/780190
DATED : March 26, 2013
INVENTOR(S) : Itoh et al.

It is certified that error appears in the above-identified patent and that said Letters Patent is hereby corrected as shown below:

On Title Page 2, item (56), under "OTHER PUBLICATIONS", in Column 1, Line 1, delete "Haripin" and insert -- Hairpin --, therefor.

On Title Page 2, item (56), under "OTHER PUBLICATIONS", in Column 1, Line 4, delete ""Desgin" and insert -- "Design --, therefor.

In the Specification

In Column 4, Line 37, delete "left-handed handed" and insert -- left-handed --, therefor.

In Column 7, Line 10, delete "the E" and insert -- the Σ --, therefor.

In Column 7, Line 14, delete "A" and insert -- Δ --, therefor.

Signed and Sealed this
Twentieth Day of August, 2013

Teresa Stanek Rea
*Acting Director of the United States Patent and Trademark Office*